United States Patent [19]

Rutter

[11] 4,360,996

[45] Nov. 30, 1982

[54] METHOD AND APPARATUS FOR FILLING AND SEALING PLASTIC BAG FLUID CONTAINERS

[76] Inventor: Christopher C. Rutter, 24174 Dover La., Hayward, Calif. 94541

[21] Appl. No.: 177,725

[22] Filed: Aug. 13, 1980

[51] Int. Cl.[3] ..... B65B 1/18

[52] U.S. Cl. ..... 53/469; 53/266 R; 141/10; 141/114; 141/314

[58] Field of Search ..... 53/266 R, 469, 479; 141/10, 67, 68, 114, 166, 302, 311 R, 313–317, 392

[56] References Cited

U.S. PATENT DOCUMENTS 4,066,108 1/1978 Lau ..... 141/68

*Primary Examiner*—Frederick R. Schmidt

*Attorney, Agent, or Firm*—Linval B. Castle

[57] ABSTRACT

Flexible heat-sealable plastic bags to be filled with a fluid or loose particulate material without exposure to the atmosphere are connected to the elliptical nozzle of the filling machine by use of overlapping ellipses. A filling hole, either elliptical or circular, cut in a corner from another otherwise sealed bag will readily slip over the larger elliptical nozzle. The bag is then tightly clamped by a movable member pressing against the rear surface of the elliptical nozzle of the filling machine while the bag is filled with its material through the nozzle. The bag is subsequently heat-sealed around the hole with a heated ring, and a suction stem is inserted into the sealed-off filling hole to withdraw any residual fluid.

8 Claims, 7 Drawing Figures

FIG. 5
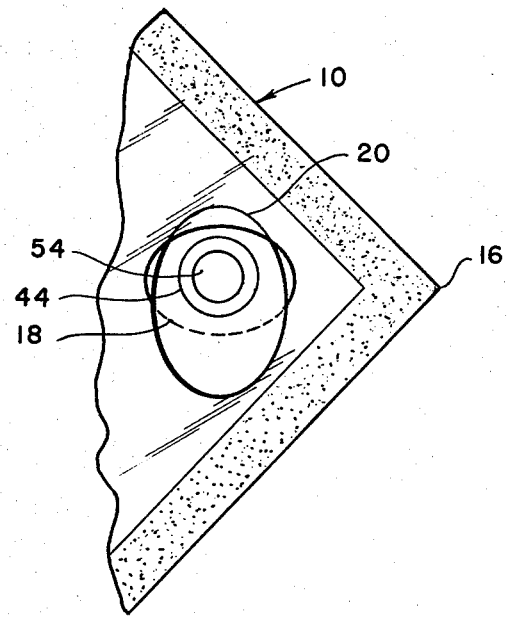
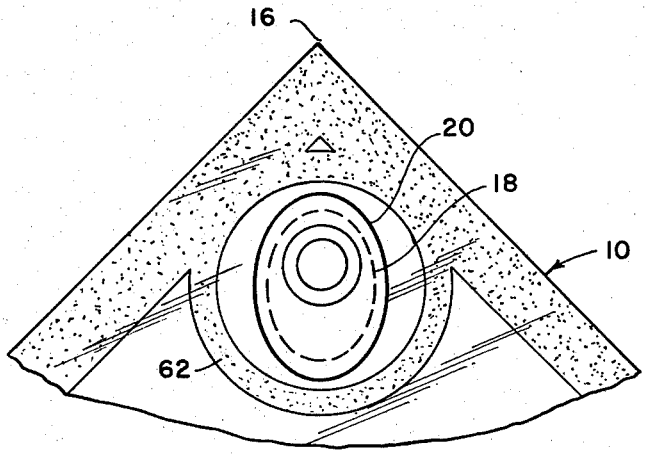
FIG. 6
FIG. 7
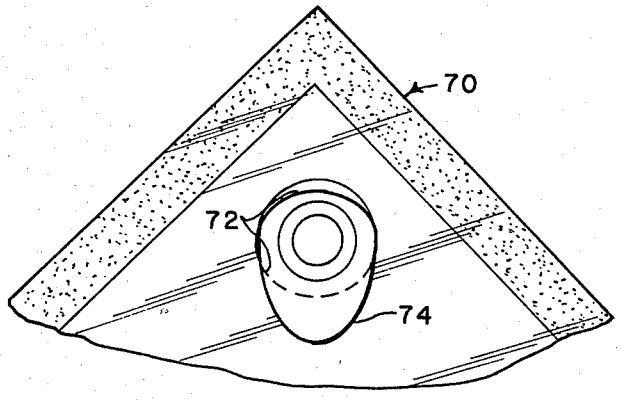

METHOD AND APPARATUS FOR FILLING AND SEALING PLASTIC BAG FLUID CONTAINERS

CROSS-REFERENCE TO RELATED APPLICATION

The method and apparatus described herein is related to my application Ser. No. 141,068, filed Apr. 17, 1980, now U.S. Pat. No. 4,322,018, issued Mar. 30, 1982. This patent describes and claims a fluid dispenser having means for piercing a sealed plastic bag for removing the fluid therefrom without exposing the fluid to the atmosphere.

BRIEF SUMMARY OF THE INVENTION

This invention relates generally to the packaging of a material such as a fluid in heat-sealable plastic bags without exposing the material to the atmosphere, and the invention relates particularly to a method and apparatus for clamping a preformed plastic bag having a filling hole in one surface to a substantially elliptical dispensing nozzle of a filling machine and, subsequent to the filling of the bag, heat-sealing around the filling hole. The planar end surface of the dispensing nozzle may be varied between an ellipse and an oval but will be referred to hereinafter as an elliptical dispensing nozzle.

The filling and sealing of plastic bags without exposing the contents to the atmosphere becomes important if the bag is to contain such materials as corrosive or explosive powdered materials or fluids that may contaminate the atmosphere or become contaminated if exposed to the atmosphere.

There are several methods by which sealable plastic bags may be filled, the simplest probably being merely positioning the open end of the bag over a filling pipe twisting the bag to seal. Automatic filling equipment cannot readily be adapted to such a method, however, and it is more desirable to provide a bag with a fill hole that can easily be attached to the dispensing nozzle of a filling machine.

Some plastic bags designed specifically for the storage and dispensing of a fluid such as wine, are provided with a fitment that serves the two purposes of both filling and dispensing from the bag. The fitment can be closed off with a cap or valve after filling and is later used for dispensing the contained fluid. A plastic bag containing such a dispensing, or filling, fitment is described in U.S. Pat. No. 3,223,117 to Curie et al. Such an arrangement, however, will subject the fluid contents of the bag to the atmosphere and furthermore, during the time between removal of the fitment from the filling machine and the application of the sealing cap or plugs, there is a considerable danger that some of the contents of the bag may be spilled. While this may not be important if the bag is being filled with wine and the like, it could be very serious if the contents were corrosive or flammable liquids.

The fluid filling of a plastic bag through the Curie dispensing fitment may be modified to eliminate the danger of spillage and atmospheric exposure by heat-sealing the two sides of the plastic bag together around the filling hole as described in expired U.S. Pat. No. 2,708,541 to W. C. Jones. Dispensing can then be accomplished by the use of a bag-piercing fluid dispenser such as described and claimed in my copending patent application or by slashing the bag and dumping the contents. Such a method and apparatus for filling a plastic bag with a fluid or loose particulate will protect the contents of the bag from the atmosphere at all times until subsequently dispensed therefrom. The disadvantages of such a system are: the difficulty in withdrawing the small amount of material entrapped in the fitment after the sealing operation; the cost of purchasing and affixing the fitment to the plastic bag; and the bulkiness encountered in storing large quantities of empty bags with a filling fitment attached thereto.

These disadvantages have been overcome with the method and apparatus of the invention described and claimed herein.

Briefly described, the invention includes a filling machine nozzle with a substantially elliptical face and having a pneumatically movable backing member that can clamp one side of a plastic bag against the rear surface of the elliptical nozzle. The bag is formed with a filling hole that may be circular or may be an ellipse that is similar to but smaller than the elliptical nozzle and, by rotating the bag so that the elliptical axes are substantially at right angles to each other, the bag readily fits over the nozzle. The bag is then permitted to re-rotate so that the axes are parallel and the backing member is actuated to firmly clamp the bag with the nozzle now within the bag and positioned for filling. When properly filled, a heated ring is moved to clamp both surfaces of the bag between the heated ring and the movable backing member and the bag is heat-sealed around its filling hole. A movable vacuum stem within the filling machine and coaxial with its nozzle is then actuated into the bag-filling hole to draw out all material that may remain therein, the movable backing member is then released to permit removal of filled and sealed bags from the filling nozzle.

DESCRIPTION OF THE DRAWINGS

In the drawings which illustrate the preferred embodiment of the invention:

FIG. 5 is an elevation view illustrating a portion of the bag of FIG. 1 being fitted to the elliptical face of the nozzle of FIGS. 3 and 4;

FIG. 6 is an elevation view of the portion of the bag of FIG. 5 illustrating the bag locked to the elliptical nozzle of the filling machine and after being heat-sealed; and FIG. 7 is an elevation view of a bag having a circular filling hole being fitted to an oval nozzle.

DETAILED DESCRIPTION

The invention is for a method and apparatus for filling a plastic bag with fluids or loose particulate materialswithout exposing the materials to the atmosphere and by using a flat plastic bag without attached filling fitments that add to the overall bag cost, cause bulky storage of unfilled bags, and permanently entrap small portions of material after being sealed around the fitment.

Figure 1:
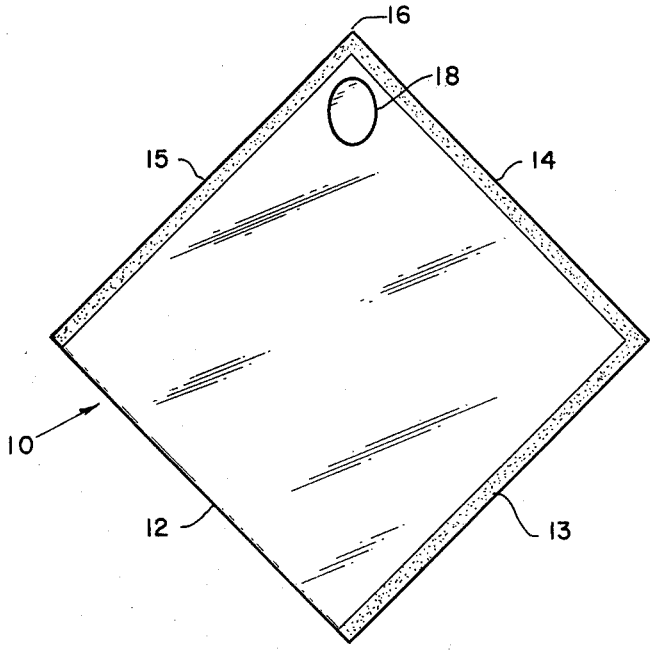
FIG. 1 is a prime view of a typical plastic bag containing an elliptical filling hole at one corner.

FIG. 1 is an illustration of a typical bag used for the sealed storage of fluids or other loose materials. Such a bag is generally formed from two or more homogeneous or laminated plies of material with the inner ply being a heat-sealable film and the other plies providing a good gas barrier and the necessary strength. As illustrated in FIG. 1, the bag 10 may be formed of a single sheet of the multi-ply laminated plastic that is folded at its center line 12 and heat-sealed together to form a sealed bag along the three remaining sides 13, 14, and 15. If desired, the bag 10 may be produced from two separate rectangular sheets that are sealed around all sides. One corner of the bag 10, which is arbitrarily designated as the top corner 16 is provided, prior to the bag assembly, with a filling hole 18 which may be substantially circular or elliptical. If elliptical, the size will, of course, depend upon the size of the bag 10, the type of material to be filled therein, and the rate at which the bag is to be filled. If the bag has a capacity of, for example, five to ten liters and is to be filled with a fluid, the elliptical hole may have a major axis length of approximately forty millimeters and a minor axis width of approximately thirty millimeters.

Figure 2:
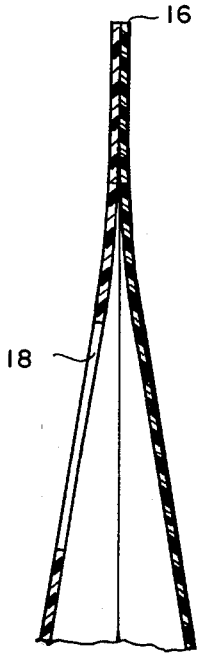
FIG. 2 is a cross-sectional view of a portion of the bag of FIG. 1 and illustrates the approximate positioning of the elliptical holes with respect to the corner of the bag.

FIG. 2 is a side cross-sectional elevation view of the bag of FIG. 1 showing a portion of the bag adjacent the top corner 16 and illustrates that the elliptical hole 18 is formed reasonably close to the sealed edge of the bag and is cut through only one side surface of the bag.

Figure 4:
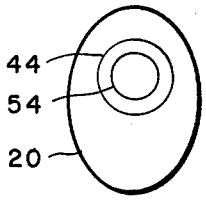
FIG. 4 is an end elevation view of the nozzle face taken along the lines 4—4 of FIG. 3.
Figure 3:
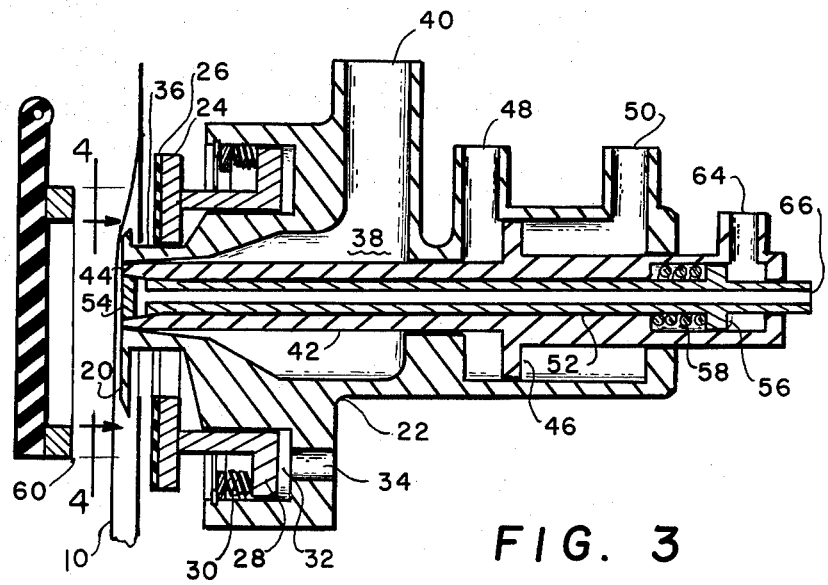
FIG. 3 is a cross-sectional elevation view of the filling nozzle of the invention.

FIG. 3 is a sectional elevation view of the filling nozzle used in connection with the bag of FIGS. 1 and 2. The filling nozzle of FIG. 3 includes a substantially elliptical face plate 20 which, for accepting the elliptical hole 18 in bag 10, may have a major axis length of approximately fifty millimeters and a minor axis width of approximately thirtyfive millimeters as best illustrated in FIG. 4. The face plate 20 is connected to the end of the nozzle housing 22 with its central axis substantially below the central filling axis of the nozzle, as will be subsequently explained. A movable clamping member 24 is provided with a resilient facing material 26 and is attached to an annular piston member 28 that is biased by springs 30 in a direction away from the face plate 20. Movement of the member 24 is provided by air pressure entering the annular cylinder 32 through the inlet port 34 and when so actuated, the movable member 24 is pressed against the rear surface of the face plate 20.

The member 24 must therefore be ring-shaped with a substantially elliptical central hole that is smaller than the elliptical face plate against which it is pressed. The operation of the filling nozzle of FIG. 3 will be later described in detail.

FIG. 5 illustrates the preferred method by which the bag 10 having an elliptical filling hole 18 is attached to the filling nozzle of FIG. 3. The bag 10 is rotated so that the arbitrarily assigned top corner 16 now lies on a horizontal axis of the bag. The major or long axis of the elliptical hole 18 is therefore also horizontal and can be slipped up over the bottom lip of the elliptical face plate 20 as illustrated in FIG. 5. The elliptical hole 18 can then be very easily drawn or stretched so that the entire hole 18, still horizontal, will entirely fit behind the face plate 20. The bag is then released and gravity returns the top corner 16 to its original position on the vertical axis of the bag, as illustrated in FIG. 6.

As illustrated in FIG. 6, both the elliptical face plate 20 and the elliptical bag hole 18 are coaxial. To maintain the elliptical bag hole 18 coaxial, its upper cut surface must rest on the top surface of the collar 36 that connects the elliptical face plate 20 to the fill nozzle housing 22, as best illustrated in FIG. 3. It thus becomes apparent that the central axis of the fill nozzle must lie above the axis of its elliptical face plate 20 to provide support for the plastic bag having an elliptical hole 18 that must be substantially coaxial with the elliptical face plate 20.

As previously mentioned, the filling hole in the bag 10 may be substantially circular and also that the nozzle face plate 20 may be oval. FIG. 7 illustrates the attachment of a bag 70 having a circular filling hole 72 to an oval nozzle face plate 74. In this embodiment the filling hole 72 has a diameter that is approximately 6 mm smaller than the width of the minor axis of the nozzle face 74 and must be distorted and stretched over the face plate 20 so that the movable clamping member 24 of FIG. 3 can properly seal the bag to the rear surface of the nozzle face plate. An advantage of an oval nozzle face 74 illustrated in FIG. 7 is that the elongated lower lip permits more rapid attachment of the bag 70 to the filling nozzle and doesn't require bag rotation.

Returning now to a description of FIG. 3, the fill nozzle housing 22 contains a chamber 38 into which material to be filled in the bag 10 is admitted through the inlet 40. A tubular valving rod 42 is horizontally movable within the chamber 38 and, in the position illustrated in FIG. 3, seals the end 44 of the chamber 38. The valving rod 42 is horizontally moved by a piston 46 and the application of air pressure to either the opening port 48 or the closing port 50. Thus, when pressure is applied to port 48, the valving rod 42 is displaced toward the right in FIG. 3 and the fluid entering inlet 40 into chamber 38 flows from the open end 44 of the chamber. When pressure is applied through closing port 50, the piston 46 drives the valving rod 42 to the left or closing position.

The tubular valving rod 42 contains a coaxial vacuum stem 52 that is movable within the bore of the valving rod 42 and independent therewith. Vacuum stem 52 has a solid end 54 that is substantially coplanar with the face of the face plate 20. The opposite end of the vacuum stem 52 is connected to a piston 56 that is normally biased by spring 58 in a direction that will maintain the vacuum stem 52 in a closed position, that is, an air-tight connection between the bore of the vacuum stem 52 and the contents of the plastic bag 10 affixed to the elliptical face plate 20.

After bag 10 has been filled with material flowing through chamber 38, and after the valving rod 42 has sealed the open end 44 of the chamber, a heated ring 60 is pressed against the bag 10 and the resilient material 26 of the clamping member 24 to seal both surfaces of the bag together around the exterior of the elliptical hole 18. The sealed portion of the bag is shown by the ring 62 as best illustrated in FIG. 6.

After sealing the bag together as illustrated in FIG. 6, any material that may remain within the bag and within the sealed bag ring 62 is withdrawn by the application of pressure into the port 64 of FIG. 3 to thereby drive piston 56 and the vacuum stem 52 toward the left so that the vacuum stem end 54 enters the bag within the sealed bag ring 62. Vacuum is then applied to the hollow bore 66 of the vacuum stem 52 and through radial holes behind the stem end 54 to thereby withdraw any material that may have become entrapped within the sealing bag ring 62 of the bag 10.

After all material has been withdrawn through the vacuum stem 52, the pressure is released from the port 34 so that the bias springs 30 will permit the movable clamping member 24 to release the bag 10. The bag may then be "unhooked" from the filling nozzle face plate 20 without danger of exposing any part of the material in the bag or remaining in the filling nozzle to the atmosphere.

I claim:

1. A method for connecting a plastic bag to a filling nozzle for filling said bag with a fluid material, said method comprising the steps of:

providing a filling nozzle with a substantially elliptical nozzle face plate, said plate having a substantially flat first and second surface, a portion of said second surface being connected to a stationary member;

providing a plastic bag that is completely sealed with the exception of a filling hole in one side thereof;

wherein said filling hole in said plastic bag is substantially elliptical and is similar to but smaller than said elliptical nozzle face plate with a maximum major axis length being greater than the width of the minor axis of said elliptical nozzle face plate; rotating said plastic bag so that the major axis of said filling hole is substantially at right angles to the major axis of said elliptical nozzle face plate; inserting said nozzle face plate through said filling hole; and re-rotating said bag to substantially align the major axis of said nozzle fact plate.

2. The method claimed in claim 1 further including the step of filling said plastic bag through an aperture in said elliptical nozzle face plate.

3. The method claimed in claim 2 wherein said plastic bag is heat-sealable and including the further step of pressing a heated sealing element against the outer surface of said plastic bag on the side of the bag opposite said filling hole to seal together both sides of said bag around the immediate area of said filling hole.

4. The method claimed in claim 3 including the additional step of inserting a tubular vacuum stem through the dispensing aperture in said filling nozzle into the sealed filling hole of said plastic bag, and applying suction to said vacuum stem for withdrawing residual fluid material from the filling hole area of said bag.

5. A filling nozzle for flowing a fluid material into a plastic bag that is completely sealed except for an elliptical filling hole in one side of said bag, said nozzle comprising:

a housing having therein a fluid material chamber having an input port and outlet port, said outlet port having a circular cross-section and extending through a tubular neck of said housing;

a movable tubular valving rod extending through said fluid chamber and into said tubular neck, said valving rod having an outside diameter substantially identical with the inside diameter of said tubular neck for blocking flow from said chamber when said valving rod is moved into a first position;

a tubular vacuum stem within and coaxial with said valving rod, said stem having a solid end section for sealing the bore of said tubular stem when retracted, said stem being movable through said valving rod for extending the end section of said stem adjacent said tubular neck through said neck to open the bore of said stem; and a substantially elliptical face plate having first and second surfaces, a portion of said second surface being connected to the end of said tubular neck and normal to the longitudinal axis thereof, the elliptical surfaces of said face plate being larger than the elliptical filling hole in said plastic bag with the longest dimension of the plastic bag elliptical filling hole being greater than the shortest dimension of said elliptical face plate.

6. The filling nozzle claimed in claim 5 further including a movable clamping member surrounding the exterior of said tubular neck, said member having an elliptical clamping face movable against the second surface of said elliptical face plate for clamping the plastic material adjacent the elliptical fill hole of said plastic bag between said clamping member and said elliptical face plate.

7. The filling nozzle claimed in claim 6 wherein said clamping member, said valving rod, and said vacuum stem are individually movable in a direction parallel with the axis of said tubular neck by associated pneumatically operable pistons.

8. The filling nozzle claimed in claims 6 or 7 further including a heat-sealing element spaced from the first surface of said face plate of said fill nozzle and movable against the face of said clamping member for sealing together the sides of a plastic bag around the elliptical fill hole of said bag.

* * * * *